US006027351A

United States Patent [19]

Hashimoto

[11] Patent Number: 6,027,351

[45] Date of Patent: Feb. 22, 2000

[54] CARD CONNECTOR

[75] Inventor: Shinichi Hashimoto, Tokyo, Japan

[73] Assignee: The Whitaker Corporation, Wilmington, Del.

[21] Appl. No.: 09/107,819

[22] Filed: Jun. 30, 1998

[30] Foreign Application Priority Data

Jun. 30, 1997 [JP] Japan ..... 9-189193

[51] Int. Cl.[7] ..... H01R 13/62

[52] U.S. Cl. ..... 439/160

[58] Field of Search ..... 439/157, 159, 439/160, 325–328, 377

[56] References Cited

U.S. PATENT DOCUMENTS

| | | | |
|---|---|---|---|
| 4,008,942 | 2/1977 | Grossi | 439/328 |
| 5,470,241 | 11/1995 | Kaufman et al. | 439/159 |
| 5,571,025 | 11/1996 | Arai et al. | 439/160 |
| 5,820,396 | 10/1998 | Pan et al. | 439/328 |

FOREIGN PATENT DOCUMENTS

| | | | |
|---|---|---|---|
| 284431 | 9/1988 | European Pat. Off. . | |
| 8-148223 | 6/1996 | Japan | H01R 13/633 |

*Primary Examiner*—Michael L. Gellner
*Assistant Examiner*—Briggitte R. Hammond

[57] ABSTRACT

A card connector is provided wherein a memory card or other such card housed in the connector can be prevented from falling out of the connector when the card is ejected, and wherein the card can be taken out of the connector with ease. The card connector is such that one side (12) of a housing (10) that houses a card (80) is provided with an ejector mechanism (50) having a cam member (30) that pushes out and ejects the card (80) from the housing. The other side (13) of the housing (10) is provided with a resilient member (60) that engages with a straight lateral edge (81) of the card (80) ejected by the cam member (30), and that restricts the movement of the card (80) in the ejection direction.

4 Claims, 4 Drawing Sheets

CARD CONNECTOR

FIELD OF THE INVENTION

The present invention relates to a card connector used in the connection of cards such as memory cards, and more particularly relates to a card connector having an ejector mechanism for ejecting a card from a housing.

BACKGROUND OF THE INVENTION

FIG. 6 shows an example of a conventional card connector 100 as disclosed in Japanese Patent Publication No. 8-148223. In connector 100, the lateral edge on one side of a housing 101 in which a plurality of contact pins 102 have been embedded is provided with an ejector mechanism 103 for ejecting a connected card 110, while the lateral edge on the other side of the housing 101 is provided with a spring tab 107 that resiliently engages with the card 110, and restricts the movement of card 110 in the eject direction.

The ejector mechanism 103 is rotatably mounted to the lateral edge on the other side of the housing 101 by means of a support shaft 103*a,* and it has a control lever 104 and an ejector arm 106 that ejects the card 110. The control lever 104 is provided with a protrusion 105 that engages with a generally semicircular notch 112 in the lateral edge of the card 110 when the card 110 is connected to the card connector 100.

Meanwhile, the spring tab 107 has a base section 109 that is embedded in and fixed to the lateral edge on one side of the housing 101, and an arcuate member 108 that engages with a generally semicircular notch 111 formed on the lateral edge of the card 110 when it has been connected to the card connector 100.

Accordingly, the holding force produced by the engagement protrusion 105 and the spring tab 107 of the ejector mechanism 103 in the notches 112 and 111 acts on the card 110 connected to the connector 100 in addition to the frictional engagement force between the card 110 and the connector 100, and this makes it possible for the card 110 to be held in a secure manner within the connector.

With this conventional connector 100, since the arcuate member 108 on the spring tab 107 engages with the notch 111 in the card 110 when it has been connected to the connector 100, the engagement force of the arcuate member 108 also acts on the lateral edge of the card 110 when the ejector mechanism 103 is operated and the card 110 is ejected, which prevents the card 110 from falling out of the connector 100.

However, since conventional connector 100 was designed so that the arcuate member 108 would fit into the notch 111 in the lateral edge of the card 110, a problem was that when the ejector mechanism 103 was operated to eject the card 110 from the connector 100, and the card 110 was removed by hand, the arcuate member 108 would snag on the notch 111, making it difficult to remove the card 110.

Also, since the spring tab 107 extended in cantilever fashion from the rear of the housing 101 in the ejection direction of the card 110 (upward in FIG. 6), when the card 110 was inserted into the connector 100, the square edges of the card 110 struck the end of the arcuate member 108, thereby hindering the insertion of the card 110 into the connector 100.

Therefore, an object of the present invention is to provide a card connector with which a memory card or other such card housed in the connector can be prevented from falling out of the connector when the card is ejected, and with which the card can be removed from the connector with ease and be smoothly inserted into the connector.

SUMMARY OF THE INVENTION

The card connector of the present invention is such that one side of a housing that houses a card is provided with an ejector mechanism having a cam member that pushes out and ejects the card, wherein the other side of the housing is provided with a resilient member that engages a straight lateral edge of the card ejected by the cam member, and restricts the movement of the card in the ejection direction.

It is effective if the resilient member has a spring section that extends in cantilever fashion from the vicinity of the front end of the other side of the housing in the direction in which the card is inserted, and an engagement section that engages with the card is provided in the vicinity of the distal end of the spring section.

It is even more effective if the resilient member comprises a generally U-shaped section including a base section having a resilient lance that extends in cantilever fashion from the distal end upper portion and a spring section that bends back from a rear end of the base section and is provided with an engagement section that engages the card in the vicinity of the distal end, a slot in which the base section of the resilient member is fitted is made in the other side of the housing from the front end of the resilient member toward the rear, and an aperture in which a free end of the resilient lance is disposed is formed in an upper wall of the slot.

BRIEF DESCRIPTION OF THE DRAWINGS

An embodiment of the present invention will now be described by way of example with reference to the accompanying drawings in which:

FIG. 5B is a front view, and FIG. 5C is a left side view of FIG. 5B.

DETAILED DESCRIPTION OF THE INVENTION

Figure 1:
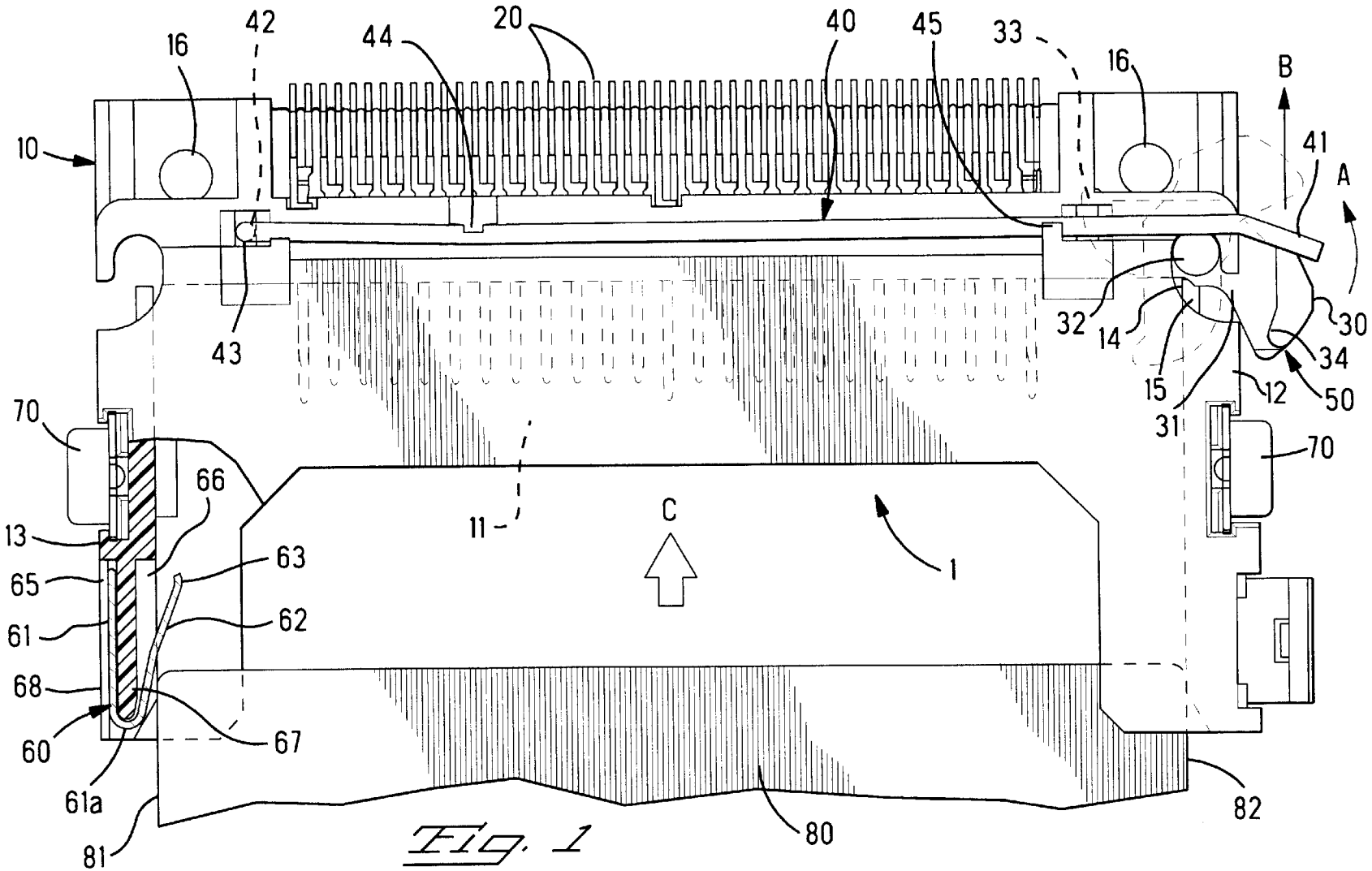
FIG. 1 is a top plan view partly in cross section of the main components of a card into a card connector of the present invention and illustrates a state midway through the insertion of a card into the card connector.
Figure 2:
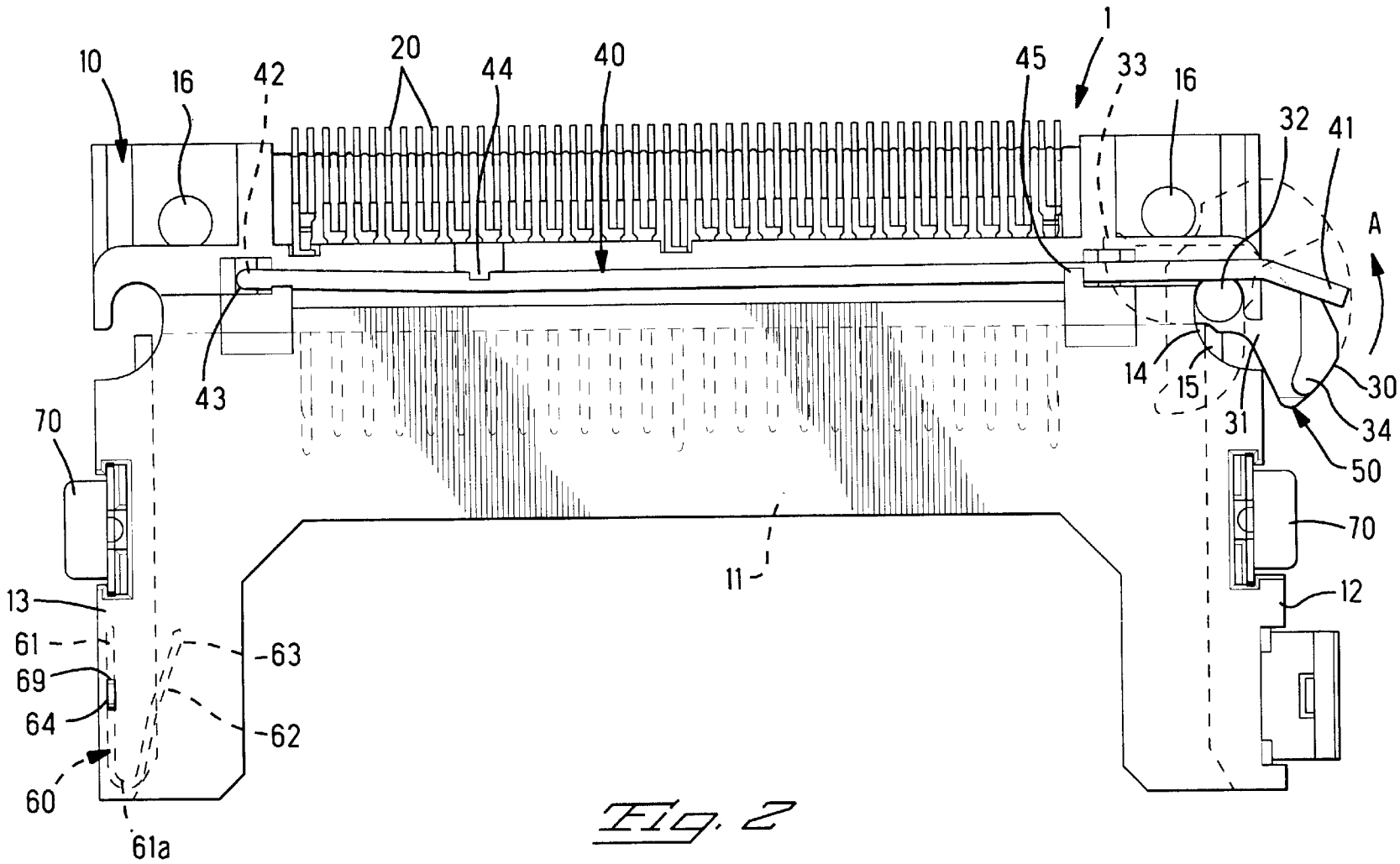
FIG. 2 is a top plan view of the card connector shown in FIG. 1.
Figure 3:
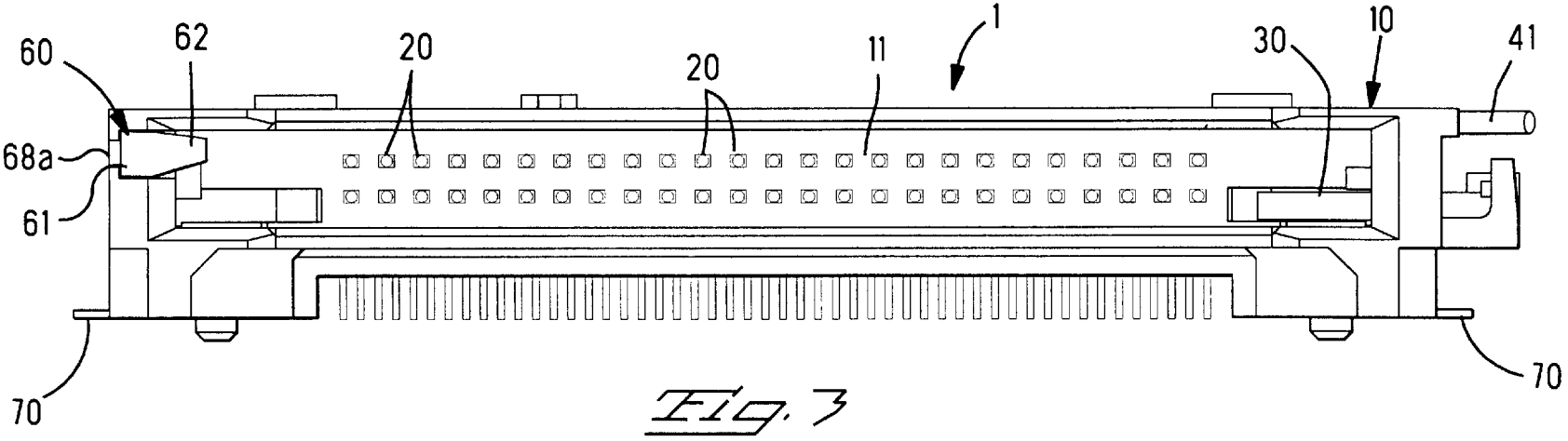
FIG. 3 is a front view of the card connector shown in FIG. 1.
Figure 4:
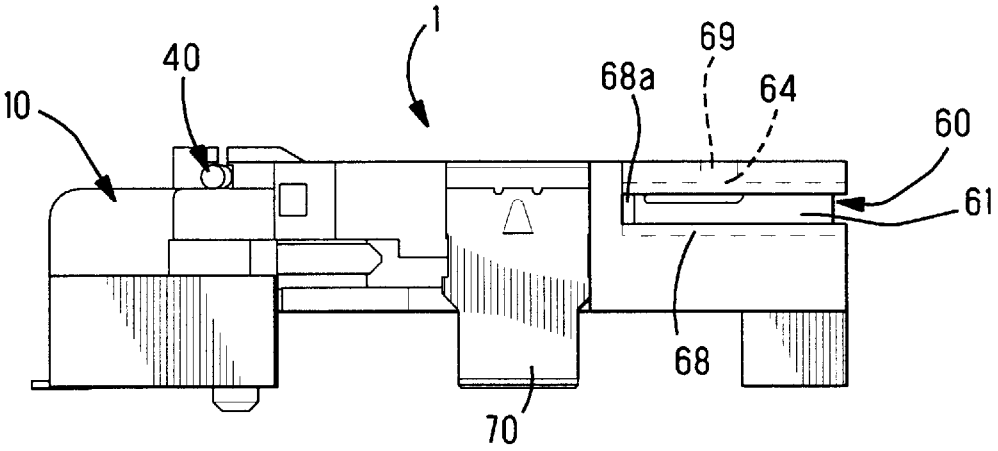
FIG. 4 is a left side view of the card connector shown in FIG. 1.

As shown in FIGS. 1–4, card connector 1 comprises a housing 10 having a card-receiving section 11 that houses a flash memory card 80 (hereinafter referred to simply as a card) that is inserted in the insertion direction C; a plurality of pin-shaped electrical contacts 20, that are press-fitted and fixed in the housing 10 and that are electrically connected to the card 80; an ejector mechanism 50 that is mounted on one side 12 of the housing 10, that is used for ejecting the card 80; and a resilient member 60 is mounted on the other side 13 of the housing 10, that restricts the movement of the card 80 in the ejection direction. The card 80 housed in the card-receiving section 11 does not have to be a flash memory card, and it may instead be a PC card, a hard disk, or other such card, as long as it is connected to contacts 20. The lateral edges 81 and 82 of the card 80 are straight.

The card connector 1 is intended to be mounted on a printed circuit board (not shown), and a plurality of threaded holes 16 that accept attachment screws for attaching and fixing to the printed circuit board are located on both sides of a rear portion (the front portion in direction C in FIG. 1) of the housing 10, and a reinforcing metal member 70 for stronger attachment to the printed circuit board is provided to the one side 12 of the housing 10 and to the other side 13 thereof. The plurality of pin-shaped contacts 20 and the reinforcing metal members 70 are soldered to pads (not shown) on the printed circuit board.

The ejector mechanism 50 is equipped with a cam member 30 that is rotatably mounted on the one side 12 of the housing 10, a spring member 40 supported on an upper surface of the housing 10, and a lever (not shown) that is provided along the one side 12 of the housing 10, which is slidable relative thereto.

The cam member 30 has a shaft member 32 that protrudes from a lower surface of a base portion 31, an ejector arm 33 that extends from the base portion 31 into the card-receiving section 11 and is used for ejecting the card 80, and a lever-engagement projection 34 that extends from the base portion 31 to the outside and engages with the lever. The cam member 30 is integrally molded from a suitable resin material. The shaft member 32 is rotatably disposed inside a cam member-supporting opening 14 in the one side 12 of the housing 10. A resilient arm 15 extends from the one side 12 of the housing 10 toward the cam member-supporting opening 14, and resilient arm 15 supports the lower surface of the base portion 31 of the cam member 30 as well as the shaft member 32, thereby preventing the cam member 30 from leaving the housing 10.

The spring member 40 is a metal wire, one end of which is provided with a lever-engagement section 41 that engages with the lever, and the other end is provided with a shaft section 42 that is bent downward at an approximate right angle. The shaft section 42 of the spring member 40 is installed in a hole 43 in an upper surface of the rear portion of the housing 10, with a rear end of the spring member 40 closer to the shaft section 42 being supported by a support member 44 on the upper surface of the housing 10, while a front end of the spring member 40 closer to the lever engagement section 41 is supported by a support member 45 on the upper surface of the housing 10.

The lever (not shown) is disposed slidably along the one side 12 of the housing 10 and engages both with the lever-engagement projection 34 of the cam member 30 and with the lever-engagement section 41 of the spring member 40. When the lever is pushed in the B direction shown in FIG. 1, the cam member 30 rotates in the A direction and ejects the card 80 housed in the housing 10. Once the lever reaches its final end position, and the pushing force is relaxed, the lever is pushed back in the opposite direction from the B direction by the force of the spring member 40, and it returns to its original position.

Figure 5A:
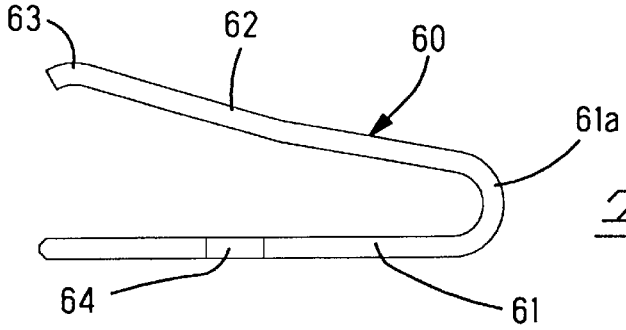
FIGS. 5A–5C show a resilient member, with FIG. 5A being a top plan view.
Figure 5B:
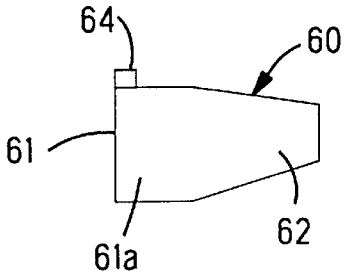
Figure 5C:
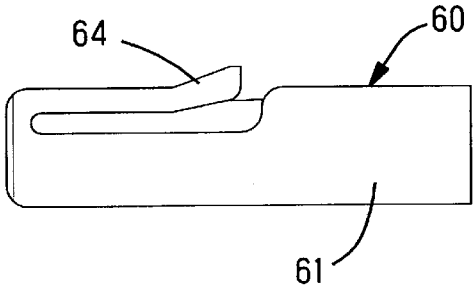
Figure 6:
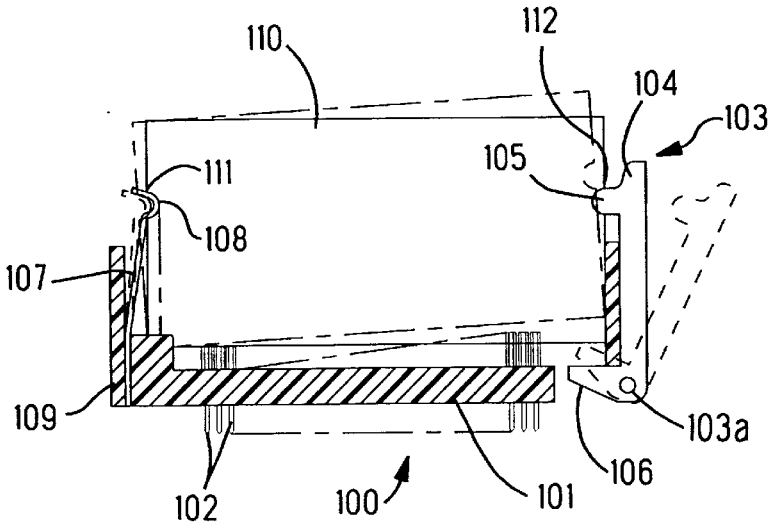
Fig. 6 (Prior Art)
FIG. 6 is a cross-sectional view of a state in which a card has been installed in a conventional card connector.

FIGS. 5A–5C show the resilient member 60 attached to the other side 13 of the housing 10. As shown, the resilient member 60 is a generally U-shaped spring tab formed by stamping and forming a metal sheet. The resilient member 60 comprises a base section 61 and a spring section 62 folded back from a rear end of the base section 61. An engagement section 63, that engages with the straight lateral edge 81 of the card 80, is formed in the vicinity of the distal end of the spring section 62. The spring section 62 tapers toward its distal end from a curved section 61*a*, and the cross-sectional quadric moment gradually becomes smaller toward the distal end. An upper portion of the base section 61 is provided with a resilient lance 64 for mounting the resilient member 60 on the other side 13 of the housing 10. The resilient lance 64 extends in cantilever fashion from the upper portion of the base section 61 at a distal end thereof.

Meanwhile, a slot 65 into which the base section 61 of the resilient member 60 is fitted is located in the other side 13 of the housing 10 to which the resilient member 60 is attached, with slot 65 facing rearward. Also, a groove 66 in which the spring section 62 of the resilient member 60 is housed when engaged with the straight lateral edge 81 of the card 80 is provided such that it communicates with the slot 65 at the outer ends of the slot 65 and the groove 66. The groove 66 is open on the inside. A partition wall 67 is provided between the slot 65 and the groove 66, and the curved section 61*a* between the base section 61 and the spring section 62 of the resilient member 60 engages an outer end of the partition wall 67 when the base section 61 of the resilient member 60 has been fitted into the slot 65. An aperture 69 (see FIG. 2) in which a free end of the resilient lance 64 is disposed when the base section 61 of the resilient member 60 has been fitted into the slot 65 is located in the upper wall of the other side 13 of the housing 10.

As shown in FIG. 1, when the base section 61 of the resilient member 60 is fitted into the slot 65 from the front end of the housing 10, and the free end of the resilient lance 64 is in the aperture 69, the resilient member 60 is fixed in the housing 10 in a state in which the spring section 62 of the resilient member 60 is extended in cantilever fashion in the insertion direction C of the card 80 from the vicinity of the front end of the other side 13 of the housing 10. The fixing of the resilient member 60 to the other side 13 of the housing 10 can be easily accomplished merely by inserting the base section 61 into the slot 65 of the housing 10 until the free end of the resilient lance engages the aperture 69. An outer wall 68 with a slit 68*a* is provided in the center on the outside of the slot 65, and the fit of the resilient member 60 within slot 65 can be checked through slit 68*a*.

In FIG. 1, when the card 80 is inserted into the card-receiving section 11 of the card connector 1 from the front of the housing 10 in the card insertion direction C, the engagement section 63 of the spring section 62 of the resilient member 60 engages with the straight lateral edge 81 of the card 80, the spring section 62 is displaced about the curved section 61*a*, the spring section 62 is housed inside the groove 66 of the housing 10, and the card 80 is connected to the pin contacts 20 of the card connector 1. Because the spring section 62 of the resilient member 60 extends in cantilever fashion in the insertion direction C of the card 80 from the vicinity of the front end of the other side 13 of the housing 10, and because the engagement section 63 is provided in the vicinity of the front end of the spring section 62, the spring section 62 of the resilient member 60 does not hinder card insertion as the card 80 is inserted into the card-receiving section 11 of the card connector 1, and the card 80 can be inserted smoothly thereinto.

If the lever (not shown) is pushed in the B direction shown in FIG. 1 so as to rotate in the A direction the cam member 30 provided on the one side 12 of the housing 10 in a state in which the card 80 is housed inside the card-receiving section 11 of the card connector 1, then the card 80 will be ejected outside the card connector 1 by the ejector arm 33 of the cam member 30. Here, since the engagement section 63 of the resilient member 60 is engaged with the straight lateral edge 81 of the card 80, movement of the card 80 in the ejection direction is restricted by the force of the spring section 62 thereby preventing the card 80 from falling out of the card connector 1 and damage to the card 80 is also avoided, even when the card 80 is used in portable devices, which are prone to the card falling out. Also, since the resilient member 60 is engaged with the straight lateral edge 81 of the card 80, the resilient member 60 does not snag on the lateral edge 81 of the card 80 when the card 80 is removed by hand, thereby allowing the card 80 to be removed more easily.

One side of the housing of the card connector of the present invention is provided with an ejector mechanism having a cam member, while the other side of the housing is provided with a resilient member that engages with a straight lateral edge of a card ejected by the cam member, and that restricts the movement of the card in the ejection direction, so that the card is prevented from falling out when a card is ejected by the ejector mechanism member. Moreover, the card can be taken out more easily when it is removed by hand.

The resilient member is provided with an engagement section that is part of a spring section extending in cantilever fashion in the insertion direction of the card from the vicinity of a front end of the other side of the housing, and that engages with the card in the vicinity of the front end of the spring section, so that the spring section does not hinder card insertion when the card is being inserted into the card-receiving section of the card connector, and the card can be inserted smoothly into the card-receiving section of the card connector.

The mounting of the resilient member to the other side of the housing can be easily accomplished merely by inserting a base section of the resilient member into a slot of the housing so that a free end of a resilient lance engages an aperture in the housing thereby securely latching the resilient member in the housing.

I claim:

1. A card connector comprising a housing having a card-receiving section for receiving a card therein;

an ejector mechanism mounted on one side of the housing having a cam member for engaging an end of the card to eject the card from the card-receiving section; and a resilient member mounted on the other side of the housing including an engagement section extending into the card-receiving section for engaging a straight lateral edge of the card thereby restricting movement of the card in the ejection direction, and a spring section extended in cantilever fashion from a front end of the other side of the housing in the direction in which the card is inserted, and said engagement section is located at a distal end of said spring section.

2. The card connector as claimed in claim 1, wherein the resilient member includes a base section disposed in a slot in the other side of the housing, and a curved section is located between the base section and the spring section.

3. The card connector as claimed in claim 2, wherein said base section has a resilient lance with a free end thereof being disposed in an aperture in the housing thereby securing the resilient member in the housing.

4. The card connector as claimed in claim 3, wherein the resilient lance is a cantilever member.

* * * * *